US005593380A

United States Patent [19]

Bittikofer

[11] Patent Number: 5,593,380

[45] **Date of Patent: * Jan. 14, 1997**

[54] APPARATUS FOR PRODUCING MULTIPLE MOTIONS

[76] Inventor: Raymond P. Bittikofer, 215 Park La., Springboro, Ohio 45066

[ * ] Notice: The term of this patent shall not extend beyond the expiration date of Pat. No. 5,474,520.

[21] Appl. No.: 527,271

[22] Filed: Sep. 12, 1995

Related U.S. Application Data

[63] Continuation of Ser. No. 212,118, Mar. 14, 1994, Pat. No. 5,474,520.

[51] Int. Cl.[6] ..... A61H 1/00

[52] U.S. Cl. ..... 601/27; 601/29; 601/33

[58] Field of Search ..... 482/29, 80, 139, 482/140, 5, 71, 147; 601/26, 27, 29, 31, 32, 33, 34, 40, 242–245; 5/607, 610, 616, 617, 618; 108/7; 297/423.46

[56] References Cited

U.S. PATENT DOCUMENTS

| | | | |
|---|---|---|---|
| 2,631,300 | 3/1953 | Murray | 5/616 |
| 4,494,259 | 1/1985 | Miller et al. | 5/616 |
| 5,203,321 | 4/1993 | Donovan et al. | 482/79 |

*Primary Examiner*—Richard J. Apley
*Assistant Examiner*—Jeanne M. Clark
*Attorney, Agent, or Firm*—Standley & Gilcrest

[57] ABSTRACT

An apparatus is described which is capable of producing multiple motions. The apparatus is useful in one embodiment as a continuous passive motion foot or hand machine.

4 Claims, 2 Drawing Sheets

APPARATUS FOR PRODUCING MULTIPLE MOTIONS

This is a continuation application of U.S. patent application Ser. No. 08/212,118, filed Mar. 14, 1994 entitled APPARATUS FOR PRODUCING MULTIPLE MOTIONS, now U.S. Pat. No. 5,474,520.

TECHNICAL FIELD

This invention relates generally to an apparatus capable of producing multiple motions, and more particularly an apparatus that is useful in actuation of a continuous, passive motion apparatus of the type which is particularly useful in post operative, rehabilitation therapy for a human ankle or other extremity.

BACKGROUND ART

The art associated with the present invention is the art of apparatus which produce motion. Various apparatus may be found in numerous different contexts, which impart motion in some form. For purposes of providing at least one context in which such an apparatus may be useful, much of the following is devoted to the context of continuous, passive motion apparatus. The present inventor has recognized several uses for the apparatus of the present invention in addition to use with or as a continuous, passive motion machine.

Human joints, and muscles associated with the joints, may be weakened or traumatized as a result of disease, injury or a surgical procedure. Prolonged inactivity of the joint can be a deterrent to recovery and can result in reduced limits of joint function. Movement of the joint hastens and improves rehabilitation, but may be difficult or painful for a patient. Consequently, the art has recognized the need for machines which can provide passive exercise, operating the joints and flexing the muscles over restricted limits which may be increased as rehabilitation progresses.

A variety of such apparatus has been proposed and are commonly called continuous, passive motion or CPM systems. With a CPM system it is desirable to drive a foot supporting platform not only in dorsiflexion and plantar flexion over a range of angular displacement, but also in eversion and inversion over a range of angular displacement. Preferably, a CPM machine can provide both simultaneously and in a smoothly blended, continuous motion.

Apparatus proposed by the art suffers from one or both of two principal disadvantages. Several such devices generate only one motion. Others either do not permit adjustments in the angular displacement range over which the foot support platform is driven or, at best, have adjustments which are difficult for the therapist to make and/or can be varied only over a relatively narrow range. Most require an inconvenient mechanical adjustment of the apparatus.

It is one object and feature of the present invention to provide a therapeutic CPM machine which imposes a continuous, passive motion upon a support platform for supporting a foot or other extremity, such as a hand, with the motion being easily controlled and varied without mechanical adjustment over a broad range of inversion and eversion angular displacement and speed, and simultaneously over a broad range of dorsal and plantar flexion angular displacement and speed. This allows a therapist to select and change, from time to time, the amplitude and speed of the angular excursions and the angle of the limits of those excursions in both the eversion/inversion direction, as well as in the dorsal/plantar flexion direction.

BRIEF DISCLOSURE OF INVENTION

The present invention is an apparatus which may include a support platform for supporting and/or moving an object, for example a foot, through a multiplicity of orientations about two pivot axes. A pair of independently operable actuators, preferably linear actuators, may be mounted to a base or a support frame. A support platform may be movably mounted to the support frame for permitting pivotal movement about two pivot axes, preferably a horizontal pivot axis for obtaining dorsal and plantar flexion (or analogous motions) and a second pivot axis which is perpendicular to the horizontal pivot axis for permitting eversion and inversion. A pair of drive links, each link preferably including a universal hinge at each of its ends, are preferably connected between the actuators and the support platform. One of the drive links may be connected between a first one of the actuators and the movable support platform and the other drive link may be connected between the second one of the actuators and the movable support platform. Preferably the actuators are each operated by a different, controllable position motor, such as a stepper motor, which is connected to a microprocessor control circuit which independently drives both actuators over a controllable and variable, selected range within their maximum operation ranges, for controlling the motion of the support platform about both pivot axes.

Figure 1:
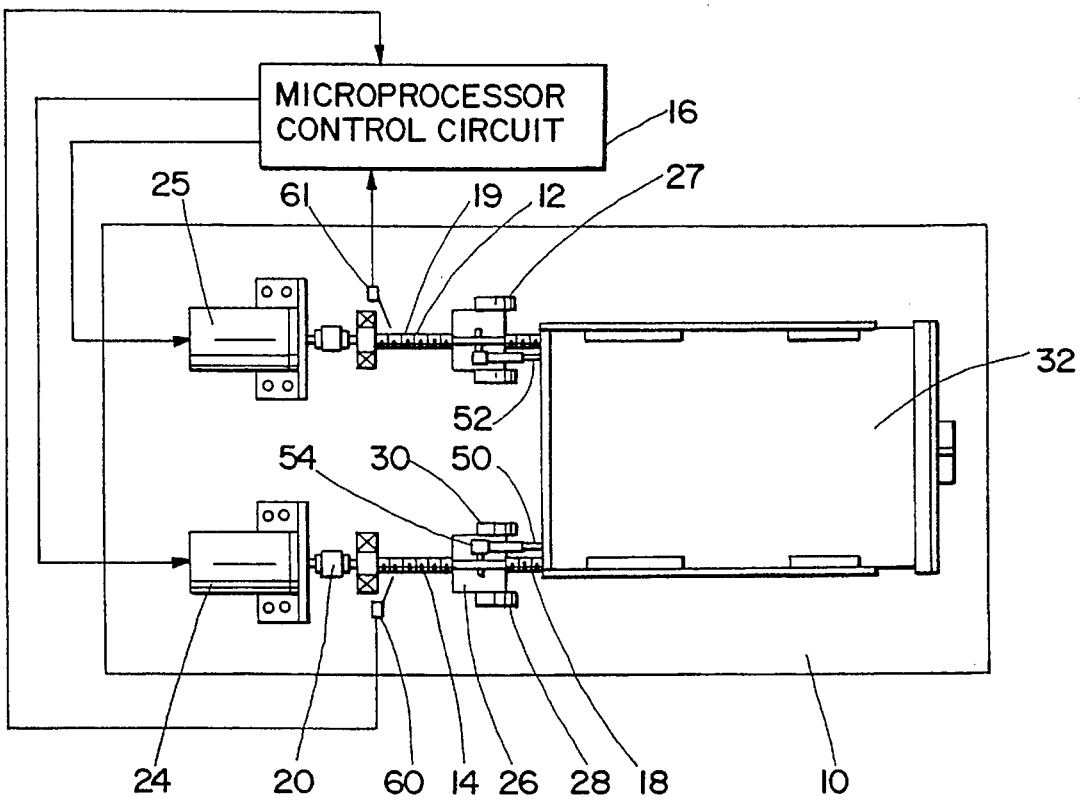
FIG. 1 is a top plan view of one preferred embodiment of the invention and also diagrammatically illustrating the connection of the control circuit.
Figure 2:
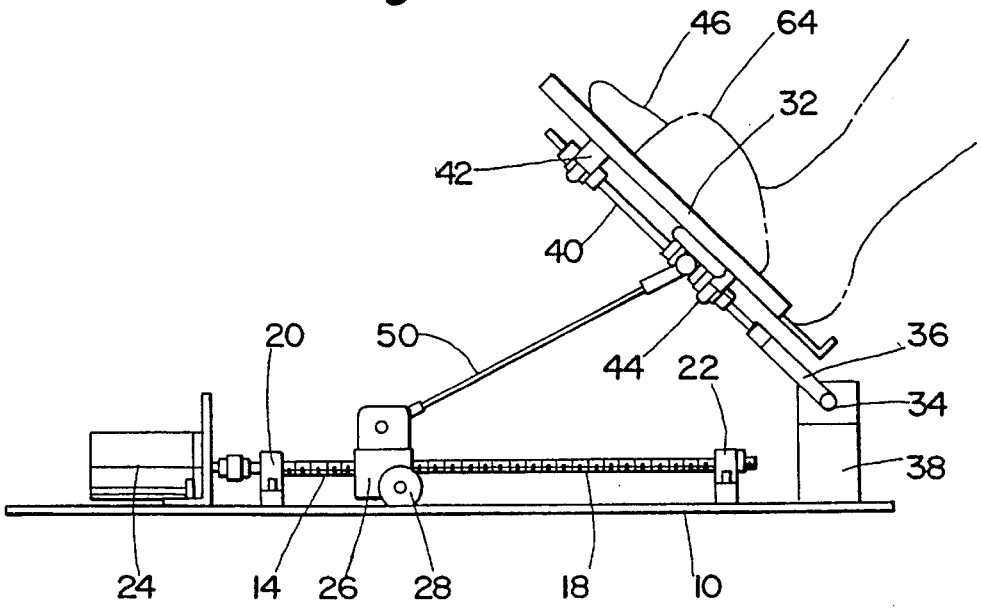
FIG. 2 is a view in side elevation of the embodiment illustrated in FIG. 1.

In describing the preferred embodiment of the invention which is illustrated in the drawings, specific terminology will be resorted to for the sake of clarity. However, it is not intended that the invention be limited to the specific terms so selected or to the embodiment in which the invention is utilized, and it is to be understood that each specific term includes all technical equivalents which operate in a similar manner. For example, the word "connected" or terms similar thereto are often used. They are not limited to direct connection but include connection through other elements where such connection is recognized as being equivalent by those skilled in the art.

DETAILED DESCRIPTION

The embodiment, illustrated in FIGS. 1–4, has a support frame 10 which is a flat base plate upon which the remaining structures may be mounted. A pair of independently operable, linear actuators 12 and 14 are mounted on the support frame 10. Each of the linear actuators 12 and 14 are independently connected to a microprocessor control circuit 16 so each may be independently operated by the control circuit 16.

The preferred actuators are preferably linear actuators and are preferably identical, and therefore only the linear actuator 14 is described in further detail. While a variety of linear actuators may be used, such as hydraulic rams, compressed air or pneumatic cylinders, or a rack and pinion, the preferred linear actuator comprises a lead screw 18 which is rotatably mounted to a pair of thrust bearings 20 and 22, bolted to the support frame 10. The lead screw 18 is preferably an acme screw and is drivingly connected to a controllable position motor, such as a conventional stepper motor 24. As is known to those skilled in the art, a stepper motor is a controllable positioned motor and is actuated by pulses, each of which turn the motor through a preselected, angular displacement. Therefore, the angular position of the motor is known by the number and polarity of the electrical pulses which have been applied to the motor. The preferred stepper motor provides 200 steps per 360 degrees of rotation, and can operate as high as 16,000 steps per second. The stepper motor is, therefore, easily and accurately controlled and provides a wide range of angular velocity. As will be apparent to those skilled in the art, a variety of other controllable position motors are available for use with the actuators in place of the stepper motors. For example, a DC motor, combined with a shaft encoder, can also be used.

A variety of alternative position detector systems can also be applied to embodiments of the present invention. For example, a linear encoder could be utilized, positioning, for example, a series of phototransistors along and parallel to the path of each nut member 26 and by mounting a light emitting diode upon each nut member 26 to actuate the nearby photo transistor.

A nut member 26 may be threadedly engaged on the lead screw 18. A pair of rotatable wheels 28 and 30 are mounted to an axle to protrude downwardly from the nut member 26 and roll along the top surface of the support frame 10. These wheels provide a bearing which prevent rotation of the nut member 26 and also support the vertically downward component of force applied to the nut member 26.

Consequently, rotation of the stepper motor 24 in one direction, translates the nut member 26 in one direction along the support frame 10, while rotation of the stepper motor in the opposite direction translates the nut member in the opposite direction. In both cases, the horizontal displacement is directly proportional to the algebraic total of the angular displacement of the stepper motor 24. Therefore, the number and polarity of the pulses applied to the stepper motors 24 and 25 determines the position of the nut members 26 and 27. The two identical linear actuators 12 and 14 are independently operable along approximately parallel axes.

A movable support platform 32 may be mounted to permit pivotal movement about two pivot axes. The first pivot axis for the support platform 32 may be the axis of a clevis pin 34 which extends through a clevis 36 to pivotally mount the clevis 36 to a support block 38, which in turn may be fixed to the support frame 10. The clevis 36, support block 38 and clevis pin 34 together form a first hinge with a pivot axis which is preferably perpendicular to the parallel displacement paths of the linear actuators 12 and 14 and is approximately horizontal.

A support axle 40 may be oriented perpendicularly to the clevis pin 34 and fixed to the clevis 36. The axle 40 may be pivotally connected to support platform bearings 42 and 44, which in turn are fixed to the support platform 32 so that the axis of the axle 40 provides a second axis about which the support platform 32 is free to pivot. Consequently, the bearings 42 and 44 and pivot axle 40, together with the clevis 36, form a second hinge having a pivot axis substantially perpendicular to the first pivot axis through the clevis pin 34.

As a result of this mounting of the support platform 32 to the support frame 10, the inclination or pitch of the support platform 32 may be varied about the axis of the clevis pin 34 to allow for such motions as dorsiflexion and plantar flexion. Similarly, pivotal movement of the support platform 32 about the axis of the support axle 40 allows for roll of the support platform 32 to permit, for example, inversion and eversion of a foot 46, supported on the support platform 32. The foot is preferably held in place by a binding 64.

The support platform 32 may be drivingly linked to the linear actuators 12 and 14 by means of a pair of drive links 50 and 52. Each of the drive links includes a universal hinge at each of its ends, such as a ball joint, universal joint, flexible connecting shaft or any other kind of joint which allows free pivotal movement in all angles of direction about a central pivot point. For example, the drive link 50 is connected to the support platform 30 by a ball joint 53 and to the nut member 26 by a ball joint 54. Such a universal hinge or joint is necessary because roll of the support platform 32 about the axle 40 for inducing eversion and inversion will cause the upper ends of both drive links 50 and 52 to move back and forth relatively closer to and further from a central, vertical plane passing through the support axle 40.

Figure 3:
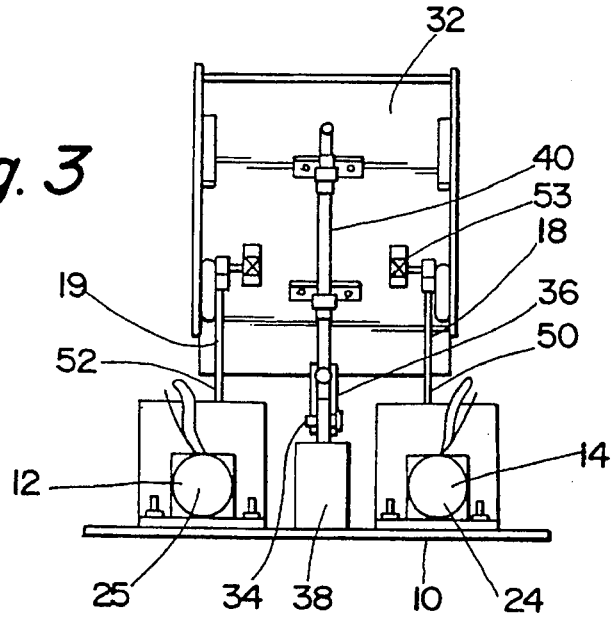
FIG. 3 is a view in end elevation of the embodiment of FIG. 1.
Figure 4:
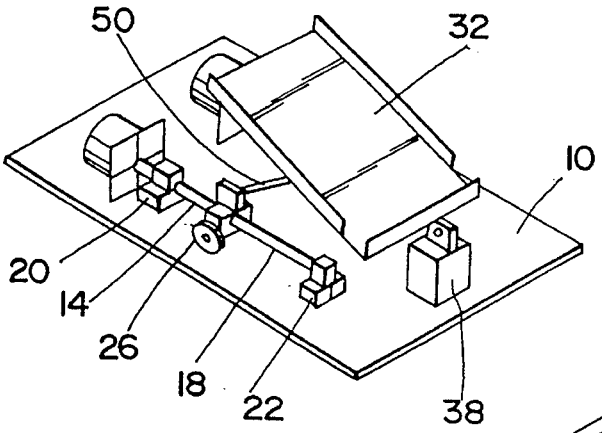
FIGS. 4, 5 and 6 are views in perspective illustrating differing positions of a movable support platform of the embodiment of the invention which is illustrated in FIG. 1.

In the operation of the preferred embodiment, actuation of the stepper motors 24 and 25 in the identical direction from the same initial position and for the identical displacement will vary only the inclination or pitch of the support platform 32 over a range of angles about the clevis pin 34. The nut members 26 and 27 translate horizontally from left to right, as illustrated in FIG. 3, to accomplish such motion as plantar flexion and dorsiflexion over a desired angular range. The angular limits over which the dorsiflexion and plantar flexion occur are determined by the linear displacement limits of the nut members 26 and 27, which, in turn, are determined by the angular displacement of the stepper motors 24 and 25.

Figure 5:
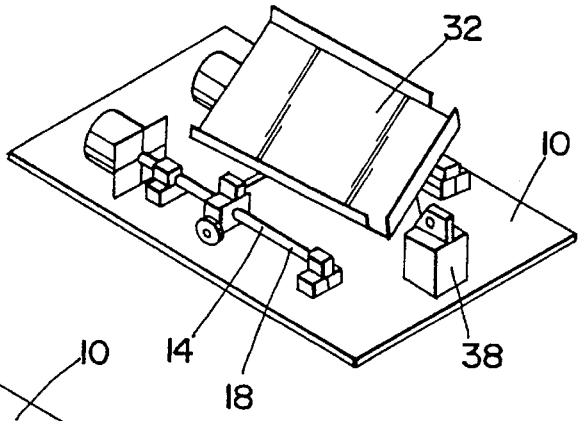
Figure 6:
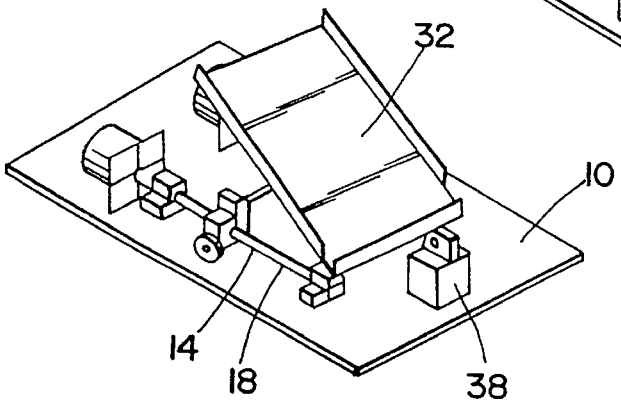

The roll motion for inducing inversion and eversion is a function of the difference between the linear displacements of one nut member from the other nut member along the parallel axes along which they reciprocate to provide different roll angles, as illustrated in FIGS. 5 and 6. Consequently, both inversion and eversion angles, as well as dorsiflexion and plantar flexion angles may be controlled and smoothly varied to provide a gentle rolling, pivoting movement by independently controlling, selecting and varying the linear positions of the nut members 26 and 27. Both of these motions may be simultaneously and smoothly blended by continuously displacing the nut members 26 and 27 along their respective lead screws 18 and 19 and simultaneously varying the difference between their displacements.

While a variety of actuators, and particularly linear actuators, may be utilized with embodiments of the present invention, the lead screw and nut arrangement illustrated is preferred. It is simple, easily controlled, and, because of the mechanical advantage, combined with friction, forces exerted during use, for example by a foot on the support platform 32, cannot be transmitted back to cause rotation of the lead screws 18 and 19, although if necessary a stepper motor can be locked in place.

The mathematical relationships relating the angular displacement of the stepper motors 24 and 25 to the pitch and roll of the support platform 32 will vary somewhat, depending on the particular embodiment of the invention which is constructed and may be determined by the application of well known principles of algebra, geometry and trigonometry or by testing to determine the particular relationship which may be used for controlling a preferred embodiment of the invention.

It is desirable in some embodiments to initialize the control circuit for the particular embodiment before proceeding with motion of the support platform 32. One manner of accomplishing this is to provide a pair of microswitches 60 and 61, located, for example, at one end of the linear translation range for the nut members 26 and 27. These microswitches are connected to the microprocessor control circuit 16. Typically, upon initial actuation of the microprocessor control circuit 16, the stepper motors are rotated to translate the nut members into contact with their respective microswitches 60 and 61. Upon actuation of its microswitch, the associated nut member is stopped and when both are stopped, the microprocessor then may store in memory this initial position. Thereafter the number of pulses and their polarity, which are applied to the stepper motors 24 and 25, may be maintained in memory so that the microprocessor is continuously aware of the position of the nut members 26 and 27. Thereafter, the microprocessor drives the stepper motors 24 and 25 according to any desired control relationship to cause the nut members 26 and 27 to reciprocate back and forth along the lead screws 18 and 19 to obtain the desired motion of the support platform 32. It should be apparent that embodiments of the present invention may be utilized beyond the field of physical therapy. The present invention may be used, for example, for supporting and varying the inclination and orientation of other types of work pieces.

While certain embodiments of the present invention have been disclosed in detail, it is to be understood that various modifications may be adopted without departing from the spirit of the invention or scope of the following claims.

I claim:

1. An apparatus for moving an object through a multiplicity of orientations about two pivot axes, the apparatus comprising:

(a) a support frame;

(b) a pair of independently operable actuators mounted to said support frame;

(c) a support platform mounted to said support frame for permitting pivotal movement about said two pivot axes;

(d) a first drive link having two ends and including a universal joint at each said end, wherein said first drive link is connected to said support platform by a respective first said universal joint, and wherein said first drive link is connected to a first one of said actuators by a respective second said universal joint; and (e) a second drive link having two ends and including a universal joint at each said end, wherein said second drive link is connected to said support platform by a respective first said universal joint, and wherein said second drive link is connected to a second one of said actuators by a respective second said universal joint.

2. An apparatus in accordance with claim 1 wherein said support platform is mounted to said support frame with a first hinge connected to the support frame and a second hinge connected to the first hinge and the support platform, the first hinge having an approximately horizontal pivot axis for permitting variable inclination of the support platform about the substantially horizontal axis and the second hinge having a pivot axis approximately perpendicular to the first pivot axis.

3. An apparatus in accordance with claim 3 wherein each of said independently operable actuators are operable along approximately parallel axes which are approximately perpendicular to the axis of the first hinge.

4. An apparatus in accordance with claim 3 wherein each of said independently operable actuators comprises a lead screw rotatably mounted to the support frame, a nut member threadedly engaged to the lead screw and a motor for drivingly rotating the lead screw in both directions.

* * * * *

UNITED STATES PATENT AND TRADEMARK OFFICE

CERTIFICATE OF CORRECTION

PATENT NO. : 5,593,380

DATED : January 14, 1997

INVENTOR(S) : Raymond P. Bittikofer

It is certified that error appears in the above-indentified patent and that said Letters Patent is hereby corrected as shown below:

In column 6, line 32, please delete the words "claim 3" and replace it with -- claim 2 --.

Signed and Sealed this

Eighth Day of April, 1997

Bruce Lehman

*Attest:*

BRUCE LEHMAN

*Attesting Officer*

*Commissioner of Patents and Trademarks*